US010854156B2

(12) United States Patent
Yamamoto

(10) Patent No.: US 10,854,156 B2
(45) Date of Patent: Dec. 1, 2020

(54) DISPLAY DEVICE FOR ELIMINATING LUMINANCE DIFFERENCE BETWEEN PIXELS

(71) Applicant: SAKAI DISPLAY PRODUCTS CORPORATION, Sakai (JP)

(72) Inventor: Akira Yamamoto, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 0 days.

(21) Appl. No.: 16/460,210

(22) Filed: Jul. 2, 2019

(65) Prior Publication Data

US 2020/0013356 A1 Jan. 9, 2020

(30) Foreign Application Priority Data

Jul. 6, 2018 (JP) ..... 2018-129318

(51) Int. Cl.
*G09G 3/36* (2006.01)

(52) U.S. Cl.
CPC ..... *G09G 3/3614* (2013.01); *G09G 3/3696* (2013.01); *G09G 2300/0426* (2013.01); *G09G 2310/0202* (2013.01); *G09G 2310/06* (2013.01); *G09G 2320/0233* (2013.01)

(58) Field of Classification Search
CPC ..... G09G 3/3614; G09G 2320/0233; G09G 2320/0223; G09G 2320/0426; G09G 3/3696; G09G 2300/0426
See application file for complete search history.

(56) References Cited

U.S. PATENT DOCUMENTS

2011/0043711 A1* 2/2011 Tsuda ..... G09G 3/3688 348/790
2011/0234625 A1* 9/2011 Irie ..... G09G 3/3648 345/601

FOREIGN PATENT DOCUMENTS

JP 2014-032282 A 2/2014

* cited by examiner

*Primary Examiner* — Xuemei Zheng
(74) *Attorney, Agent, or Firm* — ScienBiziP, P.C.

(57) ABSTRACT

A display device includes a plurality of pixels arranged in a matrix. Overlapping areas between gate electrodes and drain electrodes of switching elements connected to a plurality of selected pixel electrodes are individually set to equalize or substantially equalize retention voltages Vd(+) (Vd(−)) of the selected pixel electrodes when a specific voltage of a first polarity is applied to the selected pixel electrodes. The source application section is controlled to apply to the source lines source signals Vsc each of which is corrected by superposing a correction voltage preset for each source line on the source signal Vs(−) (Vs(+)) in application of a voltage of a second polarity to the selected pixel electrodes.

7 Claims, 12 Drawing Sheets

DISPLAY DEVICE FOR ELIMINATING LUMINANCE DIFFERENCE BETWEEN PIXELS

INCORPORATION BY REFERENCE

The present application claims priority under 35 U.S.C. § 19 to Japanese Patent Application No. 2018-129318, filed on Jul. 6, 2018. The contents of this application are incorporated herein by reference in their entirety.

BACKGROUND

The present disclosure relates to a display device in which a plurality of pixels are arranged in a matrix.

In order to inhibit degradation of display quality caused due to a rounded waveform of a gate signal, a technique in display devices called Cgd gradation has been known in which a parasitic capacitance Cgd between a gate electrode and a drain electrode of a switching element of each pixel is pre-adjusted according to a distance to each pixel from a gate application section that supplies gate signals (see Japanese Patent Application Laid-Open Publication No. 2014-32282, for example).

SUMMARY

Even in a case where Cgd gradation is adopted, luminance difference between pixels cannot be thoroughly eliminated. The inventors have studied and tackled this problem to find knowledge that a difference between a drawing voltage in application of a positive source signal and a drawing voltage in application of a negative source signal increases as a distance from the gate application section to a pixel electrode increases (that is, with an increase in degree of roundness of the waveform of the gate signal).

The present disclosure has been made in view of the above knowledge and has its main object of providing a display device with an increased display quality.

A display device according to an aspect of the present disclosure is a display device including a plurality of pixels arranged in a matrix. The plurality of pixels each include a pixel electrode. The display device includes: a plurality of gate lines extending side by side in a column direction of the matrix; a plurality of source lines extending side by side in a row direction of the matrix and intersecting with the gate lines; a plurality of switching elements that each include a gate electrode, a source electrode, and a drain electrode, and that are located in vicinity of respective intersections of the gate lines and the source lines, the gate electrode being connected to a corresponding one of the gate lines that passes through a corresponding one of the intersection points, the source electrode being connected to a corresponding one of the source lines that passes through the corresponding one of the intersection points, the drain electrode being connected to a corresponding one of the pixel electrodes of the plurality of pixels that is located in the vicinity of the corresponding one of the intersection points; a gate application section configured to sequentially apply gate signals to the gate lines, each of the gate signals being a signal for selecting a pixel group including pixels of the plurality of pixels arranged in the row direction of the matrix; a source application section configured to apply source signals to the source lines, the source signals each being a signal for applying a desired voltage to selected pixel electrodes through the switching elements, the selected pixel electrodes being pixel electrodes of the pixels included in the pixel group selected by the gate signal; and a controller configured to control the gate application section and the source application section. Under control by the controller, the source application section alternately applies a positive voltage and a negative voltage to the selected pixel electrodes for each frame, a polarity of the voltage applied to the selected pixel electrodes being determined with reference to a specific voltage. Overlapping areas between the gate electrodes and the drain electrodes of the switching elements connected to the respective selected pixel electrodes are individually set to equalize or substantially equalize retention voltages of the selected pixel electrodes when a specific voltage of a first polarity is applied to each selected pixel electrode, the first polarity being either a positive polarity or a negative polarity. The controller performs control such that correction voltages preset for the respective source lines are superposed on the source signals in application of the source signals for application of a voltage of a second polarity to each selected pixel electrode by the source application section, the second polarity being opposite to the first polarity.

DETAILED DESCRIPTION

Embodiments of the present disclosure will be described in detail below with reference to the accompanying drawings.

Figure 1:
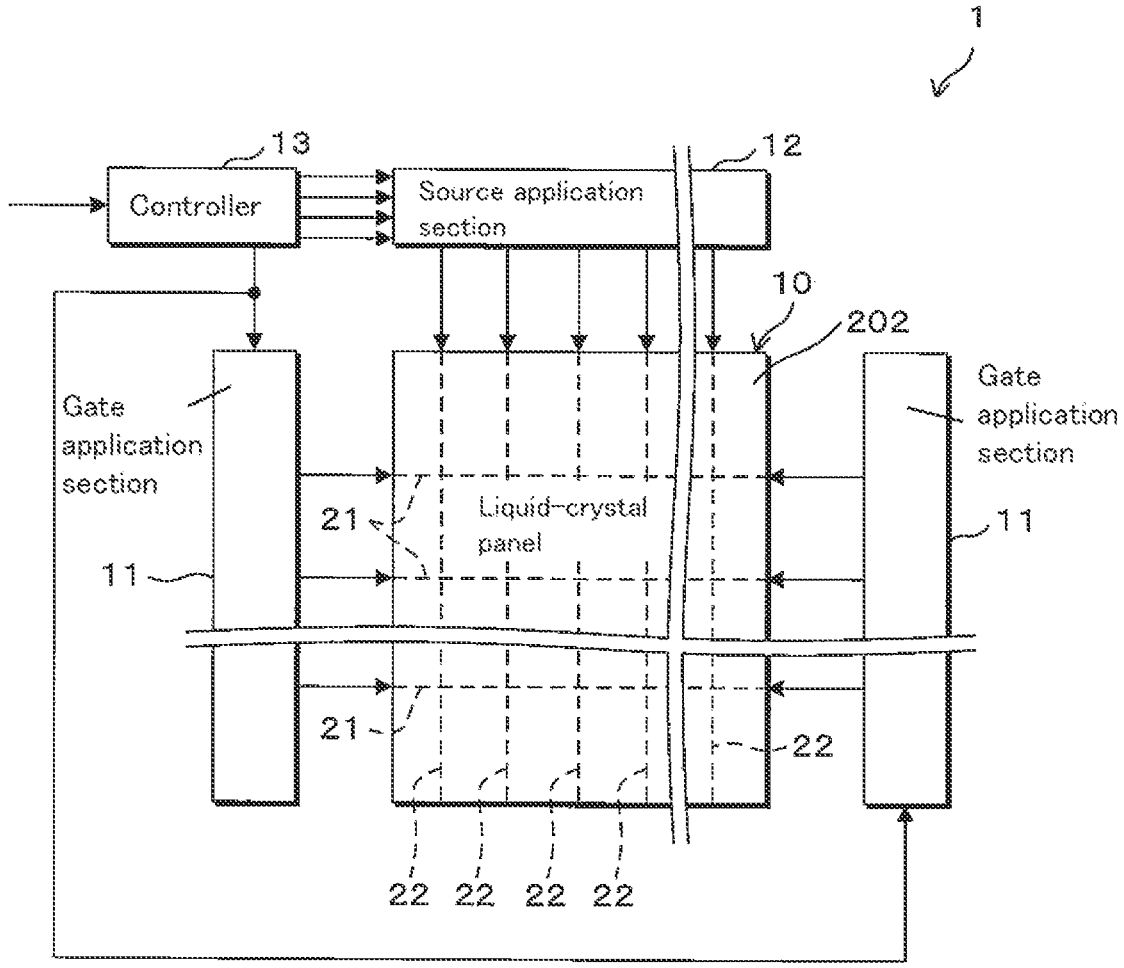
FIG. 1 is a configuration diagram of a display device according to an embodiment.
Figure 2:
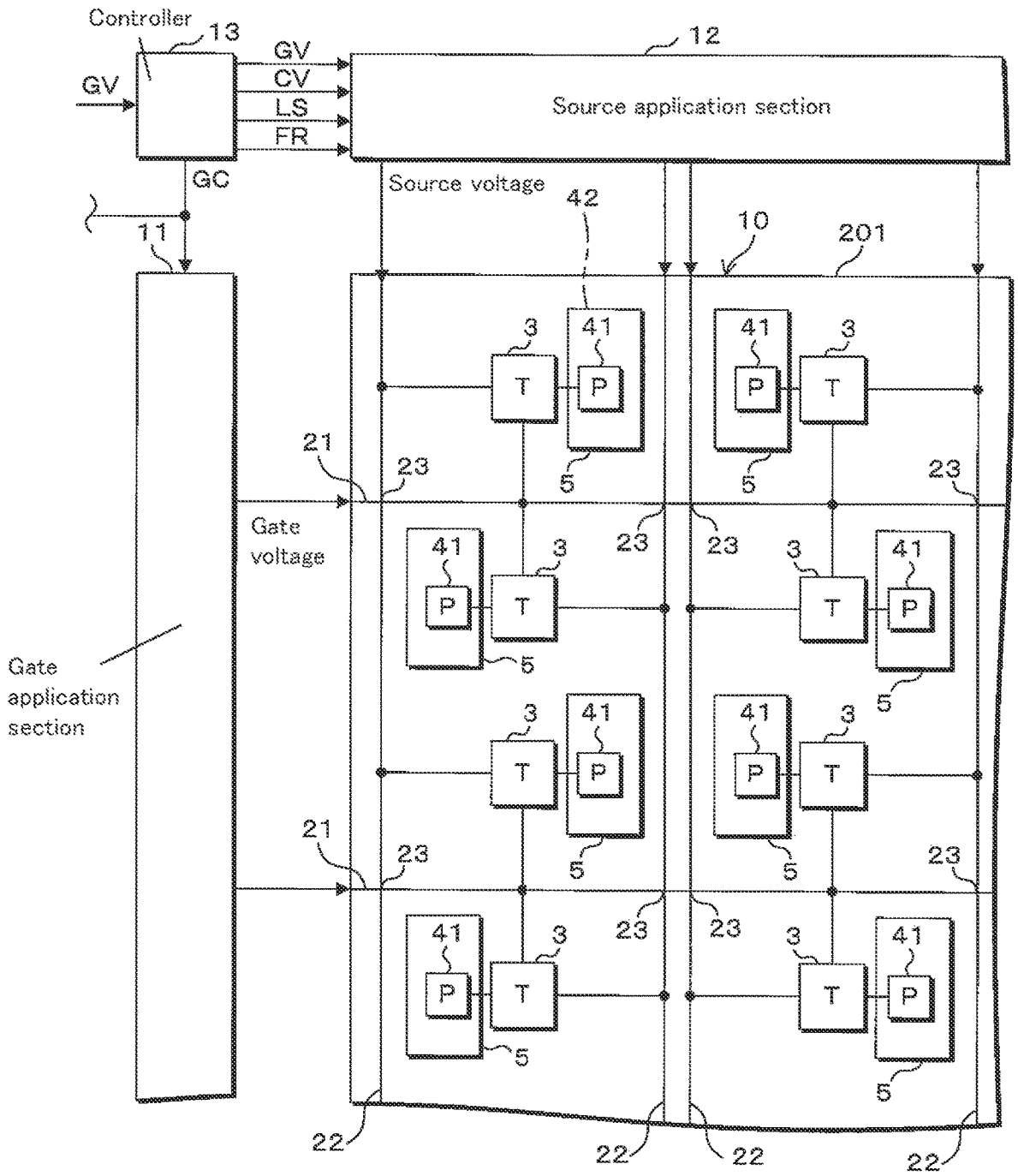
FIG. 2 is a configuration diagram of a liquid-crystal panel according to the embodiment.

FIG. 1 is a configuration diagram of a display device 1 according to an embodiment. FIG. 2 is a configuration diagram of a liquid-crystal panel 10 according to the embodiment. The display device 1 is configured as for example a display of a television receiver or a personal computer. The display device 1 includes a liquid-crystal panel 10, one or more (2 in the present embodiment) gate application sections 11, a source application section 12, and a controller 13.

The liquid-crystal panel 10 is a display panel having a surface on which a video is displayed. The liquid-crystal panel 10 includes transparent substrates 201 and 202. The transparent substrate 201 includes on a surface thereof M gate lines 21, N source lines 22, {M×N} switching elements 3, and {M×N} pixel electrodes 41. Here, M and N each represent an arbitrary plural number. In the drawings, the switching elements 3 are each represented by "T" and the pixel electrodes 41 are each represented by "P".

As illustrated in FIGS. 1 and 2, the gate lines 21 extend side by side in parallel to one another in an up-and-down direction in the drawings. Each of the gate lines 21 has opposite ends that are connected to the respective gate application sections 11. A gate clock ("GC" in the drawings) is provided to each of the gate application sections 11 from the controller 13. Upon the gate clock being provided, the gate application sections 11 apply a gate signal to each of the gate lines 21 from the respective opposite ends of the gate line 21. The gate signals are applied to the respective gate lines 21 sequentially for example from above to below. Once a gate signal is applied to the lowermost gate line 21, a gate signal is then applied to the uppermost gate line 21.

The source lines 22 extend side by side in parallel to one another in a right-left direction in the drawings. The source lines 22 intersect with the gate lines 21 with a non-illustrated insulation layer therebetween. One end (upper end in the drawings) of each of the source lines 22 is connected to the source application section 12. Gray value signals ("GV" in the drawings) indicating gray values of pixels forming a to-be-display image is provided to the source application section 12 from the controller 13. A correction voltage signal ("CV" in the drawings) indicating a later-described correction voltage is also provided for each gray value signal to the source application section 12 from the controller 13.

Each time N gray value signals are provided, one latch strobe signal ("LS" in the drawings) is provided to the source application section 12 from the controller 13. The N gray value signals and the N correction voltage signals are in one-to-one correspondence to the N source lines 22. One frame signal ("FR" in the drawings) is provided to the source application section 12 from the controller 13 each time {M×N} gray value signals are provided to the source application section 12. The {M×N} gray value signals indicate respective gray values of {M×N} pixels 5 forming one frame of a video.

Upon the latch strobe signal being provided, the source application section 12 applies positive or negative source signals according to the gray value signals to the source lines 22 through the respective one ends of the source lines 22. The larger the gray value indicated by a gray value signal is, the larger an absolute value of a voltage of a corresponding source signal is. The source signals are applied to the source lines 22 concurrently. The source application section 12 sets the polarity of each source signal for example such that source signals applied to source lines 22 adjacent to each other have polarities different from each other. The source application section 12 sets the polarities of the source signals such that the polarities of the source signals are reversed for each frame.

In a situation in which the polarity of a source signal to be applied to a source line 22 is a specific polarity (negative polarity in the present embodiment), the source application section 12 superposes a correction voltage indicated by a correction voltage signal on the source signal in application of the source signal to the source line 22. As such, the source signal on which the correction voltage is superposed is applied to the source line 22. By contrast, in a situation in which the polarity of the source signal to be applied to the source line 22 is a polarity opposite to the specific polarity (positive polarity in the present embodiment), the source application section 12 does not superpose the correction voltage indicated by the correction voltage signal to the source signal. As such, the source signal on which the correction voltage is not superposed is applied to the source line 22.

The display device 1 includes the {N×M} pixels 5 corresponding to intersection points 23 at which the gate lines 21 intersect with the source lines 22. Each of the pixels 5 includes a pixel electrode 41. The pixel electrodes 41 are in one-to-one correspondence to the switching elements 3. The pixels 5 are arranged in a matrix. That is, the gate lines 21 are arranged side by side in a column direction (the up-and-down direction in the drawings) in the matrix while the source lines 22 are arranged side by side in a row direction (the left-right direction in the drawings) in the matrix. Furthermore, the gate lines 21 and the source lines 22 intersect with one another at locations in the vicinity of the respective pixels.

Each of the switching elements 3 is a thin film transistor (TFT). The switching elements 3 are each located in the vicinity of a corresponding one of the intersection points 23 of the gate lines 21 and the source lines 22. The switching elements 3 are each connected to a gate line 21 and a source line 22 passing through a corresponding one of the intersection points 23. The switching elements 3 are each connected to a pixel electrode 41 of a pixel 5 located in the vicinity of a corresponding one of the intersection point 23. Switching elements 3 connected to an identical gate line 21 are arranged along the gate line 21. Switching elements 3 connected to an identical source line 22 are arranged along the source line 22.

Figure 3:
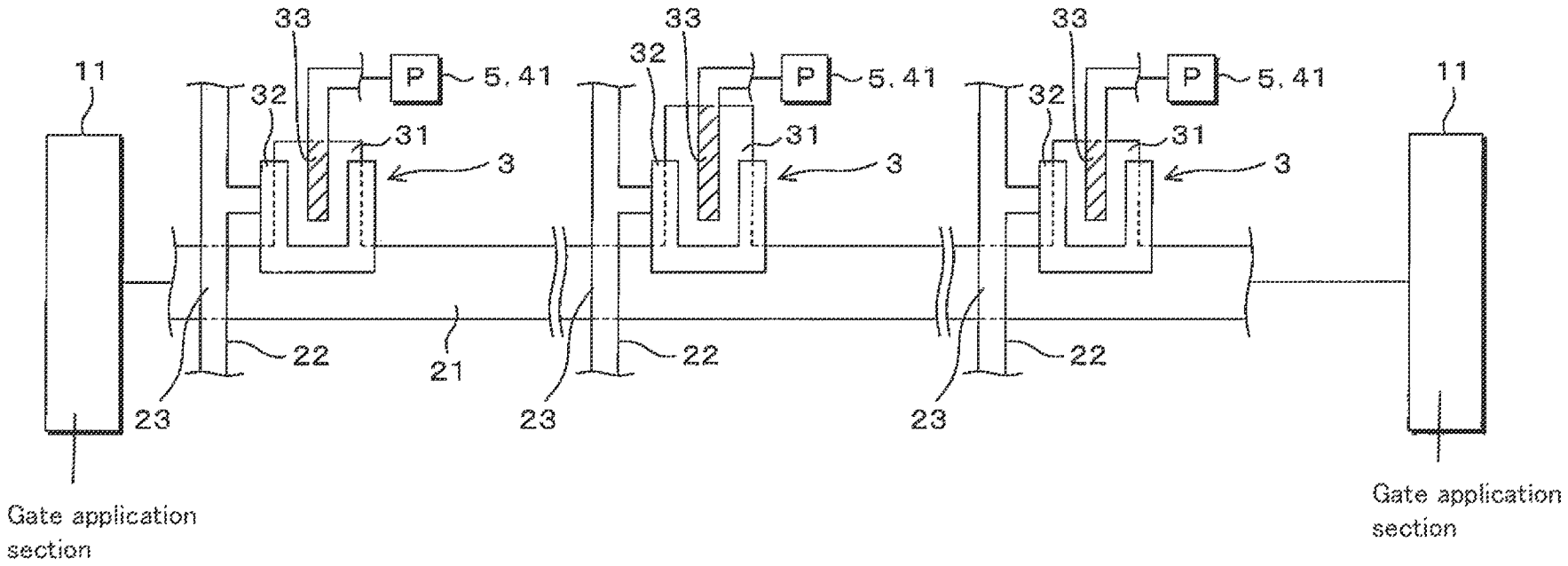
FIG. 3 is a configuration diagram of switching elements according to the embodiment.

FIG. 3 is a configuration diagram of the switching elements 3 according to the embodiment. The leftmost (or rightmost) switching element 3 in FIG. 3 is an example of switching elements 3 located close to the left (or right) gate application section 11. The switching element 3 in the middle in the left-right direction in FIG. 3 is an example of switching elements 3 located far from the gate application sections 11.

Each of the switching elements 3 includes a gate electrode 31, a source electrode 32, and a drain electrode 33. The gate electrode 31 is connected to a gate line 21 passing through an intersection point 23. A gate signal is applied to the gate electrode 31 from the gate line 21. The source electrode 32 is connected to a source line 22 passing through the intersection point 23. A source signal is applied to the source electrode 32 from the source line 22. The drain electrode 33 is connected to a pixel electrode 41 of a pixel 5 in the vicinity of the intersection point 23. The drain electrode 33 and the pixel electrode 41 are equal to each other in potential. The gate electrode 31 and the drain electrode 33 are overlaid one on the other in a direction perpendicular to the drawing surface. Hatchings in FIG. 3 represent overlaying between the gate electrode 31 and the drain electrode 33.

In the present specification, that one switching element 3 is located closer to either of the gate application sections 11 than another switching element 3 means that a length of a path along a gate line 21 from the gate application section 11 to the gate electrode 31 of the one switching element 3 is shorter than a length of a path along the gate line 21 from the gate application section 11 to the gate electrode 31 of the other switching element 3. Also, that one pixel electrode 41 is located closer to either of the gate application sections 11 than another pixel electrode 41 means that a switching element 3 connected to the one pixel electrode 41 is located closer to either of the gate application sections 11 than a switching element 3 connected to the other pixel electrode 41. By contrast, that one switching element 3 is located farther from the gate application section 11 than another switching element 3 means that a length of a path along a gate line 21 from the gate application section 11 to the gate electrode 31 of the one switching element 3 is longer than a length of a path along the gate line 21 from the gate application section 11 to the gate electrode 31 of the other switching element 3. Also, that one pixel electrode 41 is located farther from the gate application section 11 than another pixel electrode 41 means that a switching element 3 connected to the one pixel electrode 41 is located farther from the gate application section 11 than a switching element 3 connected to the other pixel electrode 41.

In a state in which a signal (also referred to below as a "gate signal" in the present specification) at a voltage higher than a threshold voltage necessary for turning on a switching element 3 is applied to a gate electrode 31 (gate-on), a corresponding source electrode 32 and a corresponding drain electrode 33 are connected to each other. When the application of the gate signal to the gate electrode 31 ends, that is, in a state in which a signal having a voltage lower than the threshold voltage is applied to the gate electrode 31 (gate-off), connection between the source electrode 32 and the drain electrode 33 is cut off. Upon gate-on in a state in which a source signal is applied to the source electrode 32, the source signal is applied to the drain electrode 33 and a corresponding pixel electrode 41 from the source electrode 32. Each voltage of the drain electrode 33 and the pixel electrode 41 accordingly becomes equal to the voltage of the source signal. By contrast, upon gate-off, the pixel electrode 41 is cut off from a corresponding source line 22 with a result that the voltage of the pixel electrode 41 is retained at a voltage (that is, retention voltage) lower by a drawing voltage than the voltage of the applied source signal.

The gate signals as described above are sequentially applied to the gate lines 21 for selection of pixel groups arranged in a row direction in the matrix. Pixel electrodes 41 connected to a gate line, to which a gate signal is applied, with the switching elements 3 therebetween may be referred to below as selected pixel electrodes 41. Selected pixel groups each are a group of pixels 5 including the selected pixel electrodes 41. The source signals are applied to the source lines 22 in order to apply desired voltages according to gray values of a to-be-displayed video to the selected pixel electrodes 41 through the switching elements 3.

The transparent substrate 202 has a surface on which a common electrode 42 is provided. The surface of the transparent substrate 202 on which the common electrode 42 is provided and the surface of the transparent substrate 201 on which the pixel electrodes 41 are provided are face each other in a direction perpendicular to the drawing surface. Crystal liquid is filled between the pixel electrodes 41 and the common electrode 42. Specific common voltage is applied to the common electrode 42. An absolute value of a difference between the retention voltage and the common voltage is referred to below as an effective voltage. Pixels 5 including the pixel electrodes 41 having effective voltages equal to one another have the same luminance. A pixel 5 including a pixel electrode 41 having a high effective voltage has a high luminance.

Figure 4:
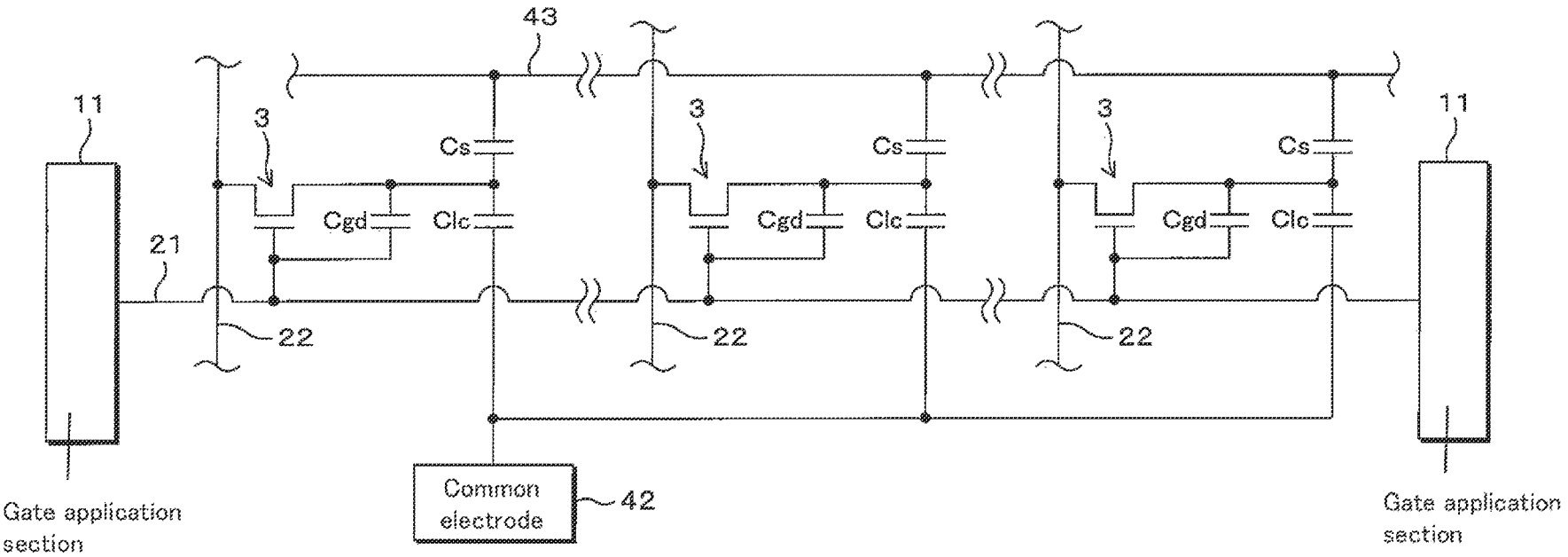
FIG. 4 is an equivalent circuit diagram of the liquid-crystal panel according to the embodiment.

FIG. 4 is an equivalent circuit diagram of the liquid-crystal panel 10 according to the embodiment. In the drawings, Cgd and Clc represent parasitic capacitance and liquid crystal capacitance, respectively. The parasitic capacitance Cgd is formed between the gate electrode 31 and the drain electrode 33 (see FIG. 3) of each switching element 3. The liquid crystal capacitance Clc is formed between each pixel electrode 41 (see FIG. 3) and the common electrode 42. M auxiliary capacitance lines 43 (only one of them is illustrated in FIG. 4) are provided in parallel to the gate lines 21 on the surface of the transparent substrate 201 on which the pixel electrodes 41 are provided. Specific auxiliary voltage is applied to each of the auxiliary capacitance lines 43. An auxiliary capacitance Cs is formed between each pixel electrode 41 and a corresponding one of auxiliary capacitance line 43.

The source signal is applied to each pixel electrode 41 (each selected pixel electrode) in a gate-on state to charge up the liquid crystal capacitance Clc. The polarity of the source signal is reversed for each frame. Accordingly, a positive voltage (source signal) and a negative voltage (source signal) are applied to the selected pixel electrodes 41 alternately on a frame-by-frame basis. Upon the gate-off, the pixel electrodes 41 are at a retention voltage. The drawing voltage is determined according to three of: the parasitic capacitance Cgd between the gate electrode 31 and the drain electrode 33 of a switching element 3 connected to a selected pixel electrode 41; a degree of roundness of the waveform of a gate signal applied to the gate electrode 31 of the switching element 3 connected to the selected pixel electrode 41; and a potential difference between the gate electrode 31 and the source electrode 32 of the switching element 3 connected to the selected pixel electrode 41 (particularly, a potential difference at re-charging). The retention voltage is kept constant by charges accumulated in the auxiliary capacitance Cs.

Figure 5:
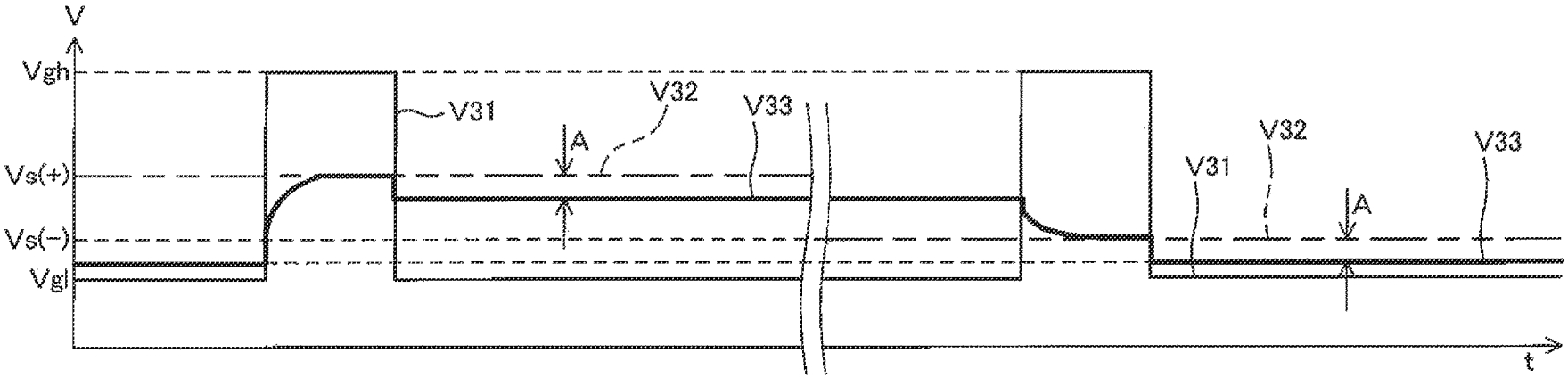
FIG. 5 is a graph representation showing time variation in voltage in a switching element located the closest to either of gate application sections.

FIG. 5 is a graph representation showing time variation in voltage in a switching element 3 located the closest to either of the gate application sections 11. In FIG. 5, a horizontal axis indicates time t and a vertical axis indicates voltage V. FIG. 5 indicates a voltage V31 of a gate electrode 31 (fine solid line), a voltage V32 of a source electrode 32 (dashed and double dotted line), and a voltage V33 of a drain electrode 33 (thick solid line).

In a state in which no gate signal is applied to the gate electrodes 31 from the gate lines 21, the voltage V31 of each gate electrode 31 is constant at a specific gate low voltage Vgl (Vgl<0). The switching element 3 is located the closest to either of the gate application sections 11, and accordingly, the waveform of the gate signal applied to the gate electrode 31 from the gate line 21 is not rounded. As such, when the gate signal is applied, the voltage V31 of the gate electrode 31 steeply increases from the gate low voltage Vgl and becomes constant at a specific gate high voltage Vgh (Vgh>0). When the application of the gate signal ends, the voltage V31 of the gate electrode 31 steeply decreases from the gate high voltage Vgh and becomes constant at the gate low voltage Vgl.

In a state in which the gate signal is not applied to the gate electrode 31, the voltage V33 of the drain electrode 33 is constant at the previous retention voltage. The left part of FIG. 5 illustrates a state in which a positive source signal Vs(+) is applied to the source electrode 32 (0<Vs(+)<Vgh). The voltage V32 of the source electrode 32 is equal to that of the source signal Vs(+). When the gate signal is applied to the gate electrode 31, the voltage V33 of the drain electrode 33 changes from the previous retention voltage and becomes constant at the voltage of the source signal Vs (+). When the application of the gate signal to the gate electrode 31 ends, the voltage V33 of the drain electrode 33 steeply decreases by the drawing voltage from the voltage of the source signal Vs(+) and becomes constant at a positive retention voltage $\alpha(+)$ ($0<\alpha(+)<Vs(+)$). The drawing voltage at this time point is represented by "A".

The right part of FIG. 5 indicates a state in which a negative source signal Vs(−) is applied to the source electrode 32 ($0>Vs(-)>Vgl$). The voltage V32 of the source electrode 32 is equal to that of the source signal Vs(−). When the gate signal is applied to the gate electrode 31, the voltage V33 of the drain electrode 33 changes from the previous retention voltage and becomes constant at the voltage of the source signal Vs(−). When the application of the gate signal to the gate electrode 31 ends, the voltage V33 of the drain electrode 33 steeply decreases by a drawing voltage from the voltage of the source signal Vs(−) and becomes constant at a negative retention voltage $\alpha(-)$ ($\alpha(-)<Vs(-)<0$). The drawing voltage at this time point is equal to "A". Therefore, the drawing voltage A satisfies the following expression (1).

$$A=|Vs(+)-\alpha(+)|=|Vs(-)-\alpha(-)| \quad (1)$$

The common voltage Vc is set to satisfy the following expression (2) for example based on the retention voltages $\alpha(+)$ and $\alpha(-)$ in manufacture of the display device 1.

$$Vc=\{\alpha(+)-\alpha(-)\}/2 \quad (2)$$

As such, the effective voltage of the positive source signal and the effective voltage of the negative source signal are equal to each other in the pixel electrode 41 located the closest to the gate application section 11.

Figure 6:
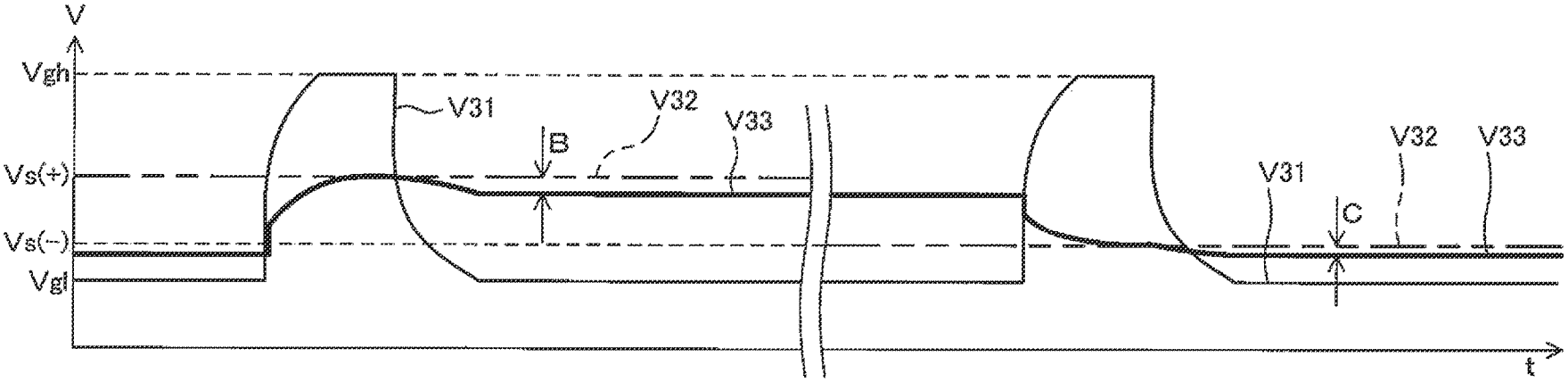
FIG. 6 is a graph representation showing time variation in voltage in a switching element located the farthest from the gate application sections.

FIG. 6 is a graph representation showing time variation in voltage in the switching element 3 located the farthest from the gate application sections 11 and 11. In FIG. 6, a horizontal axis indicates time t and a vertical axis indicates voltage V. Similarly to FIG. 5, FIG. 6 indicates the voltage V31 of the gate electrode 31, the voltage V32 of the source electrode 32, and the voltage V33 of the drain electrode 33.

Due to the presence of electric resistance and electrostatic capacitance of the gate lines 21, the waveform of the gate signal applied to each gate line 21 from each gate application section 11 becomes rounded as the distance from the gate application sections 11 increases. In FIG. 6, The switching element 3 is located the farthest from the gate application sections 11, and therefore, the waveform of the gate signal applied to a corresponding gate electrode 31 from a corresponding gate line 21 is significantly rounded. Therefore, when the gate signal is applied, the voltage V31 of the gate electrode 31 gradually increases from the gate low voltage Vgl and becomes constant at the gate high voltage Vgh. When the application of the gate signal ends, the voltage V31 of the gate electrode 31 gradually decreases from the gate high voltage Vgh and becomes constant at the gate low voltage Vgl.

The left part of FIG. 6 indicates a state in which the positive source signal Vs(+) is applied to the source electrode 32. When the gate signal is applied to the gate electrode 31, the voltage V33 of the drain electrode 33 gradually changes from the previous retention voltage and becomes constant at the voltage of the source signal Vs (+). When the application of the gate signal to the gate electrode 31 ends, the voltage V33 of the drain electrode 33 gradually decreases by a drawing voltage from the voltage of the source signal Vs(+) and becomes constant at the positive retention voltage $\beta(+)$ ($0<\beta(+)<Vs(+)$). When supposing that the drawing voltage in this state is represented by "B", the drawing voltage B satisfies the following expression (3).

$$B=|Vs(+)-\beta(+)| \quad (3)$$

The drawing voltage B is lower than the drawing voltage A in FIG. 5. Here, the reason why B<A is established will be described. That is, a time point when connection between the source electrode 32 and the drain electrode 33 is cut off is a time point when the voltage V31 of the gate electrode 31 reaches a threshold voltage that is lower than the gate high voltage Vgh and higher than the gate low voltage Vgl. In the case illustrated in FIG. 5, elapsed time for which the voltage V31 of the gate electrode 31 decreases from the gate high voltage Vgh to reach the threshold voltage is short. That is, connection between the source electrode 32 and the drain electrode 33 is immediately cut off in the gate-off state and charging to the liquid crystal capacitance Clc ends. In the case illustrated in FIG. 6 by contrast, elapsed time for which the voltage V31 of the gate electrode 31 decreases from the gate high voltage Vgh to reach the threshold voltage is long. That is, connection between the source electrode 32 and the drain electrode 33 is maintained for a while in the gate-off state and charging to the liquid crystal capacitance Clc continues for a while (so-called recharging). Therefore, the retention voltage $\beta(+)$ is higher than the retention voltage $\alpha(+)$ (see FIG. 7, which will be described later). Thus, B<A is established according to expressions (1) and (3).

The right part of FIG. 6 indicates a state in which the negative source signal Vs(−) is applied to the source electrode 32. When the gate signal is applied to the gate electrode 31, the voltage V33 of the drain electrode 33 gradually changes from the previous retention voltage and becomes constant at the voltage of the source signal Vs(−). When the application of the gate signal to the gate electrode 31 ends, the voltage V33 of the drain electrode 33 gradually decreases by a drawing voltage from the voltage of the source signal Vs(−) and becomes constant at the negative retention voltage $\beta(-)$($\beta(-)<Vs(-)<0$). The drawing voltage at this time point is represented by "C".

The drawing voltage C in FIG. 6 is lower than the drawing voltage A in FIG. 5. The reason therefor is the same as the reason for which the drawing voltage B is lower than the drawing voltage A. That is, the liquid crystal capacitance Clc is re-charged due to rounding of the waveform of the gate signal.

The drawing voltage C is lower than the drawing voltage B. Here, the reason why C<B is established will be described. That is, the switching element 3 has a characteristic (Id-Vgs characteristic) that an electric current Id starts flowing when a voltage difference Vgs between the gate electrode 31 and the source electrode 32 exceeds a specific voltage and the electric current Id increases with an increase in the voltage difference Vgs. During the time when the voltage V31 of the gate electrode 31 decreases from the gate high voltage Vgh to the threshold voltage in the gate-off state (that is, a period of re-charging), the voltage difference Vgs when the negative source signal Vs(−) is applied to the source electrode 32 is larger than the voltage difference Vgs when the positive source signal Vs(+) is applied to the source electrode 32. For example, time until the voltage V31 of the gate electrodes 31 changes from the gate high voltage Vgh to the voltage that is equal to the voltage of the source signal (that is, until a positive value of Vgs becomes 0) is longer when the negative source signal Vs(−) is applied to the source electrode 32 than when the positive source signal Vs(+) is applied to the source electrode 32. Therefore, a larger amount of the electric current Id flows in re-charging, an amount of re-charging increases, and the drawing voltage decreases by contrast when the negative source signal Vs(−) is applied to the source electrode 32 than when the positive source signal Vs(+) is applied to the source electrode 32. Thus, C<B is established.

Figure 7:
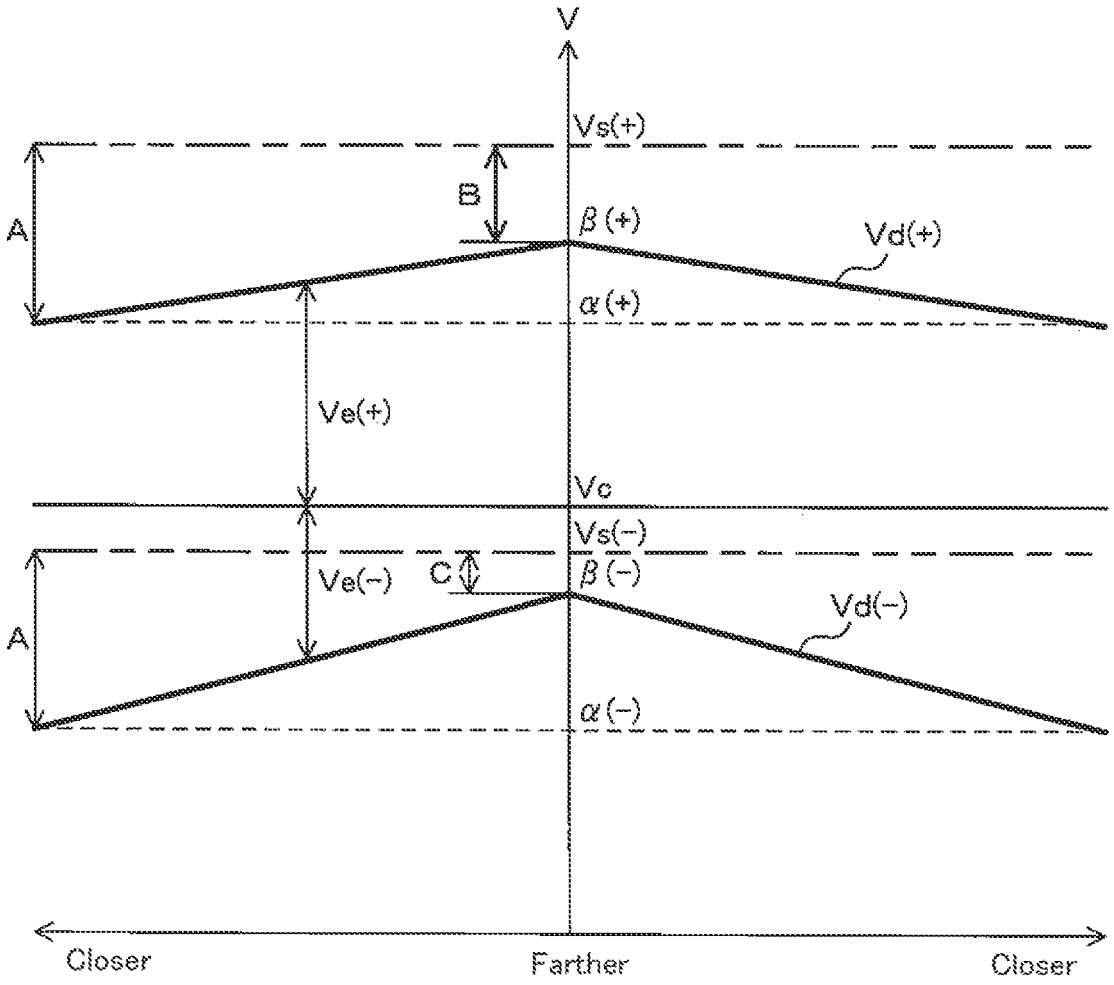
FIG. 7 is s graph representation showing relationships between positive and negative source signals and retention voltage.

FIG. 7 is a graph representation showing relationships between the positive and negative source signals Vs(+) and Vs(−) and the retention voltages Vd(+) and Vd(−). In FIG. 7, a horizontal axis indicates distance from either of the gate application sections 11, and a vertical axis indicates voltage V. The source signals Vs(+) and Vs(−) are each indicated by a dashed and double dotted line. The retention voltages Vd(+) and Vd(−) are each indicated by a thick solid line. The common voltage Vc is also indicated by a thin solid line in FIG. 7.

The retention voltage Vd(+) indicates a retention voltage of each drain electrode 33 in a state in which the positive source signal Vs(+) is applied to each source electrode 32 of the switching elements 3. The retention voltage Vd(+) of the pixel electrode 41 located the closest to either of the gate application sections 11 is represented "α(+)", while the retention voltage Vd(+) of the pixel electrode 41 located the farthest from the gate application sections 11 is represented by "β(+)". The retention voltage Vd(+) gradually increases from "α(+)" to "β(+)" as the distance from the pixel electrode 41 to either of the gate application sections 11 increases. Therefore, in application of the positive source signal Vs(+), the effective voltage Ve(+) increases as the distance from the pixel electrode 41 to either of the gate application sections 11 increases.

The drawing voltage of each of the pixel electrodes 41 is expressed by |Vs(+)−Vd(+)|. The drawing voltage of the pixel electrode 41 located the closest to either of the gate application sections 11 is "A", and the drawing voltage of the pixel electrode 41 located the farthest from the gate application sections 11 is "B" when the positive source signal Vs(+) is applied to the pixel electrode 41. The drawing voltage gradually decreases from "A" to "B" as the distance from the pixel electrode 41 to either of the gate application sections 11 increases.

The retention voltage Vd(−) indicates a retention voltage of each drain electrode 33 when the negative source signals Vs(−) are applied to the source electrodes 32 of the respective switching elements 3. The retention voltage Vd(−) of the pixel electrode 41 located the closest to either of the gate application section 11 is represented by "α(−)", and the retention voltage Vd(−) of the pixel electrode 41 located the farthest from the gate application sections 11 is represented by "β(−)". The retention voltage Vd(−) gradually increases from "α(−)" to "β(−)" as the distance from the pixel electrode 41 to either of the gate application sections 11 increases. Therefore, in application of the negative source signals Vs(−), the farther from either of the gate application sections 11 the pixel electrode 41 is located, the lower the effective voltage Ve(−) is.

The drawing voltage of each pixel electrode 41 is expressed by |Vs(−)−Vd(−)|. The drawing voltage of the pixel electrode 41 located the closest to either of the gate application sections 11 is "A", and the drawing voltage of the pixel electrode 41 located farthest from the gate application sections 11 is "C" when the negative source signal Vs(−) is applied to the pixel electrode 41. The drawing voltage gradually decreases from "A" to "C" as the distance from the pixel electrode 41 to either of the gate application sections 11 increases.

With the above configuration, luminance difference is made between the pixel 5 including a pixel electrode 41 located far from the gate application sections 11 and 11 and the pixel 5 including a pixel electrode 41 located close to either of the gate application sections 11. The luminance difference causes degradation of display quality of the display device 1.

In order to eliminate such luminance difference between the pixels, Cgd gradation and source signal adjustment are performed in the present embodiment. The Cgd gradation will be described first. The Cgd gradation is adjustment of parasitic capacitance Cgd. In a state in which source signals having the same polarity are applied to the pixel electrodes 41 in a configuration in which the switching elements 3 have the same parasitic capacitance Cgd, the drawing voltage of a pixel electrode 41 decreases with an increase in distance from the pixel electrode 41 to either of the gate application sections 11. The drawing voltage increases with an increase in the parasitic capacitance Cgd. Therefore, the drawing voltages of the pixel electrodes 41 in application of the source signals having the same polarity can be equalize by setting the parasitic capacitance Cgd appropriately large as the distance from the switching element 3 to either of the gate application sections 11 increases.

The parasitic capacitance Cgd increases with an increase in an overlapping area between the gate electrode 31 and the drain electrode 33. Accordingly, the overlapping area between a gate electrode 31 and a drain electrode 33 is increased as the distance from the switching element 3 to either of the gate application sections 11 increases (see FIG. 3).

The overlapping areas between the gate electrodes 31 and the drain electrodes 33 of the respective switching elements 3 are individually set to equalize or substantially equalize the retention voltages Vd(+) of the respective pixel electrodes 41 when a first polarity (positive polarity in the present embodiment) source signals Vs(+) (signals each having a specific voltage of the first polarity) are applied to respective pixel electrodes 41 connected to an identical gate line 21 via corresponding switching elements 3. Here, that "retention voltages Vd(+) are substantially equal to one another" means that difference in retention voltage involves no adverse influence on display quality although the retention voltages Vd(+) are not exactly equal to one another. The overlapping areas are set to equalize or substantially equalize the drawing voltages of the pixel electrodes 41 when the first polarity source signals Vs(+) are applied to the respective pixel electrodes 41.

Figure 8:
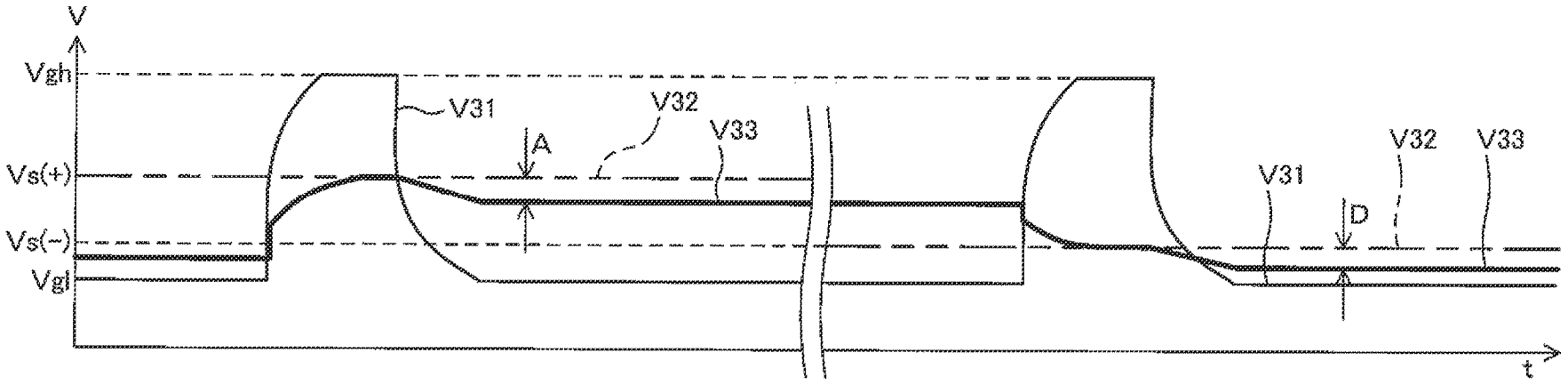
FIG. 8 is a graph representation showing time variation in voltage in the switching element located the farthest from the gate application sections when Cgd gradation is performed.

FIG. 8 is a graph representation showing time variation in voltage in the switching element 3 located the farthest from the gate application sections 11 when the Cgd gradation is performed. In FIG. 8, a vertical axis and a horizontal axis respectively indicate the same as the vertical axis and the horizontal axis in FIG. 6. Similarly to FIG. 6, FIG. 8 illustrates the voltage V31 of the gate electrode 31, the voltage V32 of the source electrode 32, and the voltage V33 of the drain electrode 33.

The left part of FIG. 8 indicates a state in which the positive source signal Vs(+) is applied to the source electrode 32. When the gate signal is applied to the gate electrode 31, the voltage V33 of the drain electrode 33 gradually changes from the previous retention voltage and becomes constant at the voltage of the source signals Vs (+). When the application of the gate signal to the gate electrode 31 ends, the voltage V33 of the drain electrode 33 gradually decreases from the voltage of the source signal Vs(+) and becomes constant at the retention voltage α(+). The drawing voltage at this time point is "A".

Figure 9:
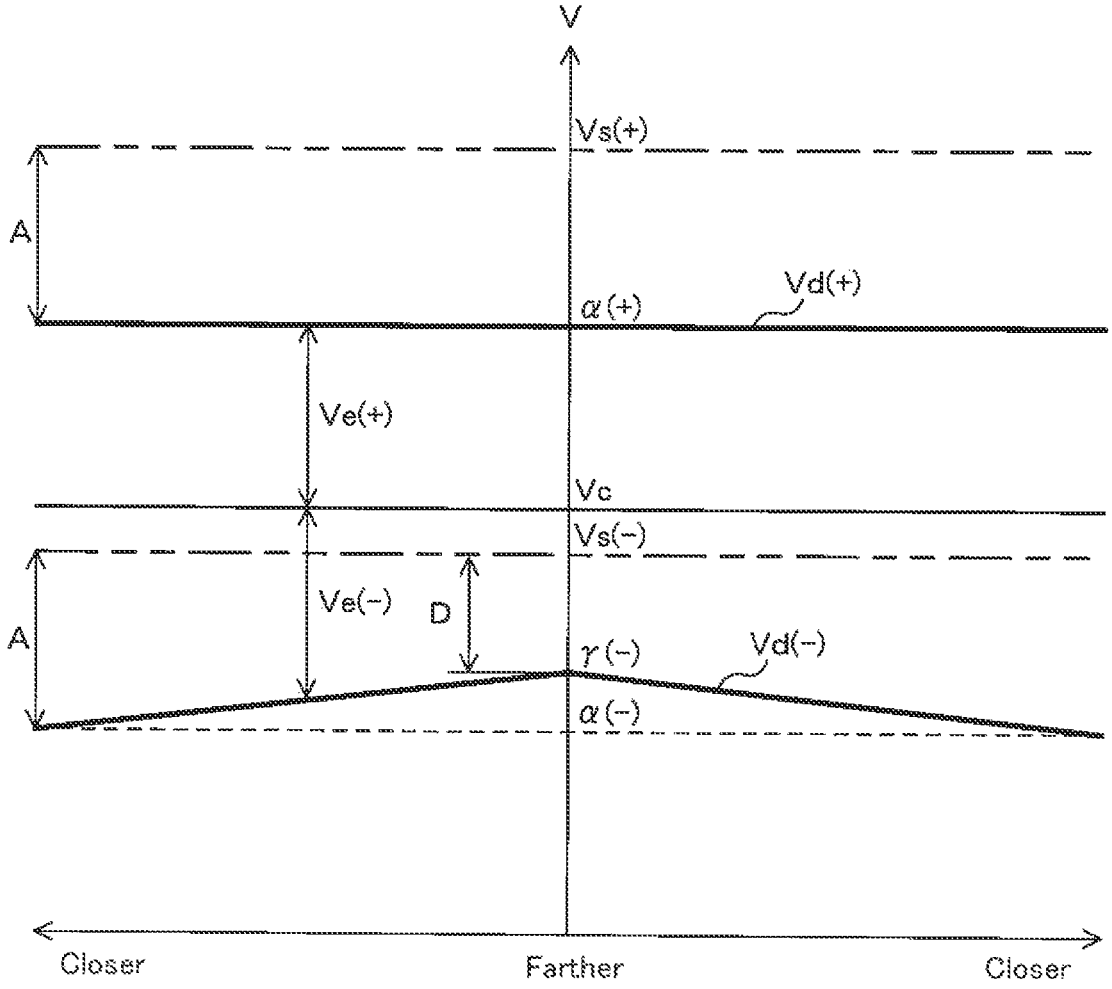
FIG. 9 is s graph representation showing relationships between the positive and negative source signals and the retention voltage when Cgd gradation is performed.

FIG. 9 is a graph representation showing relationships between the positive and negative source signals Vs(+) and Vs(−) and the retention voltages Vd(+) and Vd(−) when the Cgd gradation is performed. In FIG. 9, a vertical axis and a horizontal axis respectively indicate the same as the vertical axis and the horizontal axis in FIG. 7. Similarly to FIG. 7, FIG. 9 illustrates the source signals Vs(+) and Vs(−), the retention voltages Vd(+) and Vd(−), and the common voltage Vc. When the positive source signals Vs(+) are applied to the source electrodes 32 of the respective switching elements 3, the drain voltages are "A", that is, equal to one another regardless of the distance to either of the gate application sections 11. Therefore, the retention voltages Vd(+) of the pixel electrodes 41 are "α(+)", that is, equal to one another, and the effective voltages Ve(+) are equal to one another.

The right part of FIG. 8 indicates a state in which the negative source signal Vs(−) is applied to the source electrode 32. When the gate signal is applied to the gate electrode 31, the voltage V33 of the drain electrode 33 gradually change from the previous retention voltage and becomes constant at the voltage of the source signal Vs(−). When the application of the gate signal to the gate electrode 31 ends, the voltage V33 of the drain electrode 33 gradually decreases from the voltage of the source signals Vs(−) and becomes constant at the negative retention voltage γ(−) (γ(−)<Vs(−)<0). The drawing voltage at this time point is represented by "D".

The drawing voltage D indicated in FIG. 8 is higher than the drawing voltage C indicated in FIG. 6 (see FIGS. 7 and 9). The reason therefor is that the parasitic capacitance Cgd of the pixel 5 located the farthest from the gate application sections 11 is larger than in the case illustrated in FIG. 6 through the Cgd gradation. However, the drawing voltage D is lower than the drawing voltage A. The reason why the drawing voltage D illustrated in FIG. 8 is lower than the drawing voltage A is the same as the reason why the drawing voltage C illustrated in FIG. 6 is lower than the drawing voltage B (see FIGS. 7 and 9).

As illustrated in FIG. 9, when the negative source signals Vs(−) are applied to the source electrodes 32 of the respective switching elements 3, the retention voltage Vd(−) of the pixel electrode 41 located the closest to either of the gate application sections 11 is "α(−)" while the retention voltage Vd(−) of the pixel electrode 41 located the farthest from the gate application sections 11 is "γ(−)". The retention voltage Vd(−) gradually increases from "α(−)" to "γ(−)" as the distance from the pixel electrode 41 to either of the gate application sections 11 increases. Therefore, in application of the negative source signals Vs(−), the larger the distance from the pixel electrode 41 to either of the gate application sections 11 is, the lower the effective voltage Ve(−) is.

The drawing voltage of each pixel electrode 41 is expressed by |Vs(−)−Vd(−)|. The drawing voltage of the pixel electrode 41 located the closest to either of the gate application sections 11 is "A", and the drawing voltage of the pixel electrode 41 located the farthest from the gate application sections 11 is "D" when the negative source signal Vs(−) is applied to the pixel electrode 41. The drawing voltage gradually decreases from "A" to "D" as the distance from the pixel electrode 41 to either of the gate application sections 11 increases.

With the above configuration, luminance difference is made between the pixel 5 including a pixel electrode 41 located far from either of the gate application sections 11 and the pixel 5 including a pixel electrode 41 located close to either of the gate application sections 11. The luminance difference when the Cgd gradation is performed is smaller than the luminance difference when the Cgd is not performed. Nonetheless, luminance difference recognizable in use of the display device 1 still remains.

The following describes source signal adjustment. In the present embodiment, the negative source signals are adjusted while the positive source signals are not adjusted. The reason therefor is that luminance difference has been already eliminated by the Cgd gradation in application of the positive source signals to the pixel electrodes 41. Furthermore, the source signal adjustment is performed by superposing a correction voltage on a source signal. Accordingly, under control by the controller 13, the source application section 12 does not superpose correction voltages on source signals in positive source signal application to the pixel electrodes 41 but superposes the correction voltages on source signals in negative source signal application to the pixel electrodes 41.

Figure 10:
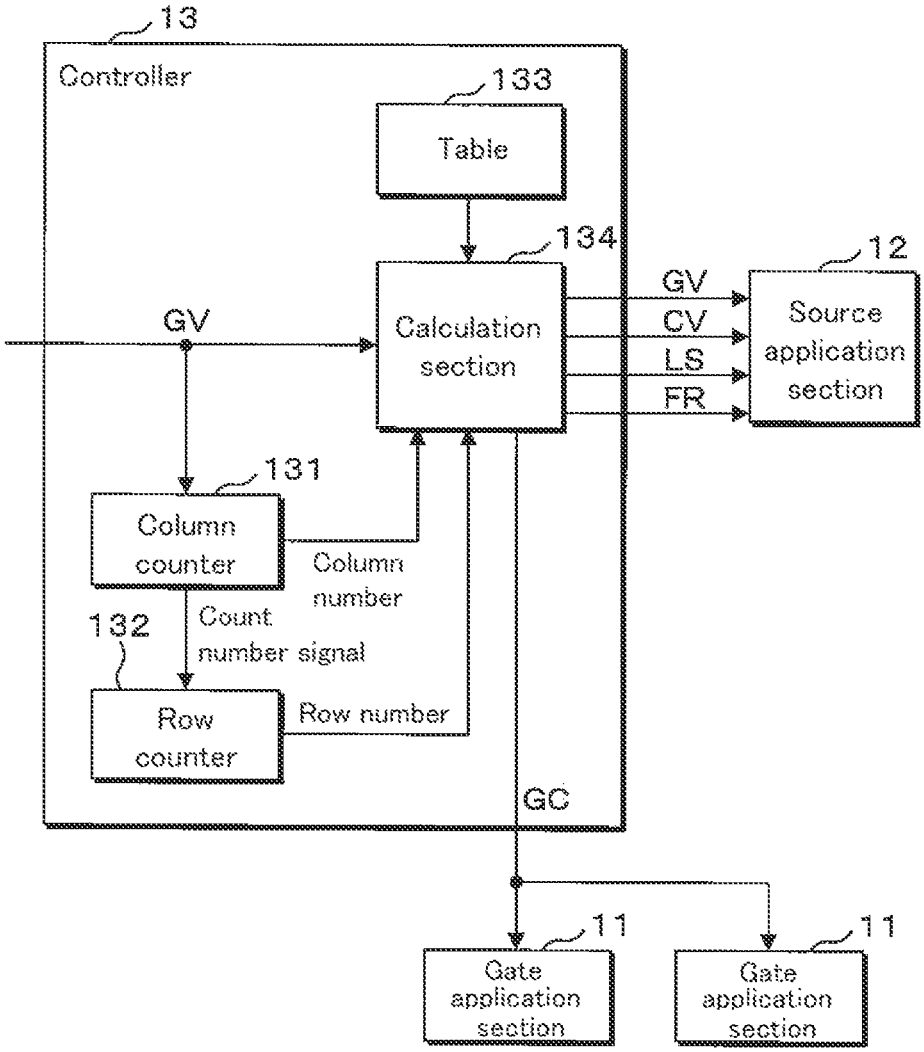
FIG. 10 is a configuration diagram of a controller according to the embodiment.

FIG. 10 is a configuration diagram of the controller 13 according to the embodiment. The controller 13 includes a column counter 131, a row counter 132, a table 133, and a calculation section 134. A plurality of gray value signals are sequentially input to the controller 13. The gray value signals input to the controller 13 are each a video signal for example that is received from the outside and that is subjected to specific signal processing. The gray value signals input to the controller 13 are provided to the column counter 131 and the calculation section 134.

Individual row numbers are assigned to the gate lines 21 in the present embodiment. The row numbers assigned to the respective gate lines 21 are "1", "2", . . . , "M" in ascending order from the uppermost gate line 21. Individual column numbers are assigned also to the source lines 22 in the present embodiment. The column numbers assigned to the respective source lines 22 are "1", "2", . . . , "N" in ascending order from the leftmost source line 22.

The column counter 131 increases a count result by "1" each time a gray value signal is provided. When a gray value signal is provided in a state in which the count result reaches "N", the column counter 131 sets the count result to "1". The initial value of the column counter 131 is "N". That is, the count result of the column counter 131 indicates the column number of a source line 22 corresponding to a gray value signal input to the calculation section 134. The column counter 131 inputs a specific count number signal to the row counter 132 when the count result is set to "1".

The row counter 132 increases the count result by "1" each time the count number signal is provided. When the count number signal is provided in a state in which the count result reaches "M", the row counter 132 sets the count result to "1". The initial value of the row counter 132 is "M". That is, the count result of the row counter 132 indicates the row number of a gate line 21 corresponding to a gray value signal input to the calculation section 134.

The table 133 is a lookup table stored in non-volatile memory. The column numbers "1" to "N" and first to N-th correction voltages are stored in association in the table 133, for example. In the following description, "N" is supposed to be an even number. In this case, for example, the first correction voltage associated with the column number "1" is 0 V and the N-th correction voltage associated with the column number "N" is 0 V. Absolute values of the second to N-th correction voltages associated with the respective column numbers "2" to "N−1" are each larger than 0 V. As for the column numbers "2" to "N/2", the larger the column number is, the larger the absolute value of the associated correction voltage is. As for the column numbers "N/2+1" to "N−1", the smaller the column number is, the larger the absolute value of the associated correction voltage is. The second to (N−1)-the correction voltages are each negative in the present embodiment.

Note that it is possible that the N column numbers are grouped into a specific number of serial column numbers and one correction voltage is associated to each group.

The calculation section 134 acquires the count result of the column counter 131 (that is, the column number) and the count result of the row counter 132 (that is, the row number) each time a gray value signal is provided. The calculation section 134 then determines a polarity of a source signal to be applied to the source line 22 to which the acquired column number is assigned. In order to do so, the calculation section 134 has a polarity flag. In a state for example in which the polarity flag is set, the calculation section 134 determines that the polarity of the source signal is positive when the column number is an odd number and determines that the polarity of the source signal is negative when the column number is an even number. In a state in which the polarity flag is reset, the calculation section 134 determines that the polarity of the source signal is positive when the column number is an even number and determines that the polarity of the source signal is negative when the column number is an odd number. When the acquired row number is "M" and the acquired column number is "N", the calculation section 134 determines the polarity of the source signal and then switches the polarity flag between being set and being reset. That is, the polarity of the source signal is reversed for each frame.

Upon determination that it is negative, the calculation section 134 provides the provided gray value signal to the source application section 12, reads out a correction voltage associated with the acquired column number from the table 133, and provides a correction voltage signal indicating the read correction voltage to the source application section 12. The correction voltages is 0 V when the column number is "1" or "N". That is, a negative source signal on which a correction voltage of 0 V is superposed is applied to each of source lines 22 connected to the pixel electrodes 41 located the closest to the respective gate application sections 11. By contrast, a negative source signal on which a negative correction voltage having a larger absolute value is superposed is applied to a source line 22 connected to the pixel electrode 41 located further from the gate application sections 11.

The correction voltages to be superposed on the respective source signals are previously determined to equalize or substantially equalize the retention voltages Vd(+) of the respective pixel electrodes 41 when a specific voltage of the second polarity (negative polarity in the present embodiment) is applied to each pixel electrode 41 connected to an identical gate line 21 through corresponding switching elements 3.

In a case where the column number is "N", the calculation section 134 provides a gray value signal and a correction voltage signal to the source application section 12, provides the gate clock to the gate application sections 11, and provides the latch strobe signal to the source application section 12. In a case where the row number is "M" in the above case, the calculation section 134 additionally provides the frame signal to the source application section 12.

To the source application section 12, N pairs of the gray value signals and the correction voltage signals are provided one by one from the calculation section 134 of the controller 13. The source application section 12 has a polarity flag. For example, each time the latch strobe signal is provided in a state in which the polarity flag is set, the source application section 12 applies positive source signals corresponding to the provided gray value signals to source lines 22 each bearing an odd number as a column number, and applies negative source signals (post-correction source signals) corrected based on the provided correction voltage signals to source lines 22 each bearing an even number as a column number. The post-correction source signals are each a negative signal corresponding to the provided gray value signal on which the correction voltage indicated by the provided correction voltage signal is superposed. In a state in which the polarity flag is reset, the calculation section 134 applies negative source signals (post-correction source signals) corrected based on the provided correction voltage signals to the source lines 22 each bearing an odd number as the column number, and applies positive source signals according to the provide gray value signals to the source lines 22 each bearing an even number as the column number. Each time the frame signal is provided, the source application section 12 switches the polarity flag between being set and being reset after the source signal application. That is, the polarity of the source signal is reversed for each frame.

In the above configuration, the controller 13 controls the gate application sections 11 and the source application section 12 by providing the gate clock to the gate application sections 11 and providing the gray value signals, the correction voltage signals, the latch strobe signal, and the frame signal to the source application section 12.

Figure 11:
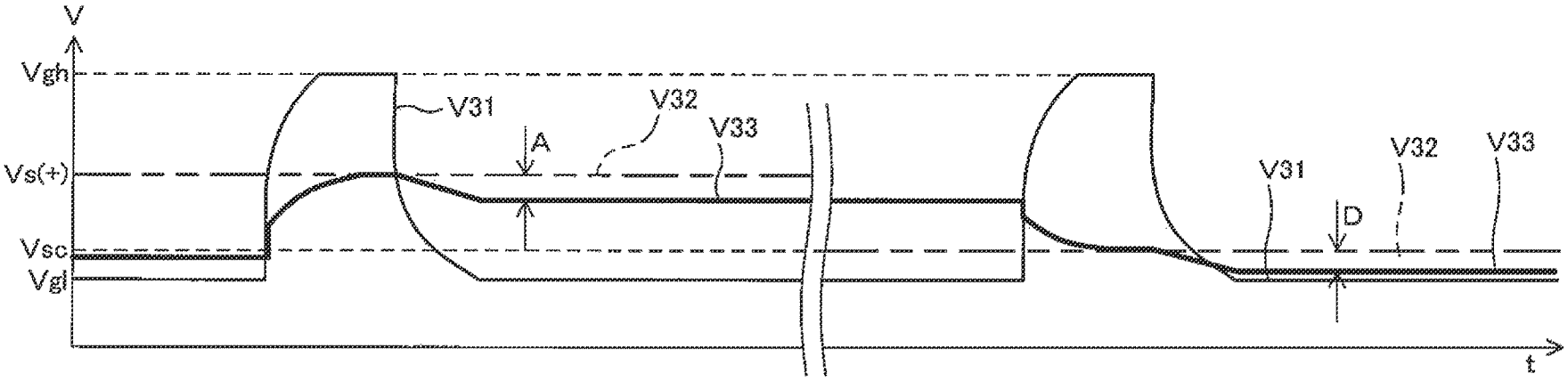
FIG. 11 is a graph representation showing time variation in voltage in the switching element located the farthest from the gate application sections when the Cgd gradation and source signal adjustment are performed.

FIG. 11 is a graph representation showing time variation in voltage in the switching element 3 located the farthest from the gate application sections 11 when the Cgd gradation and the source signal adjustment are performed. In FIG. 11, a vertical axis and a horizontal axis respectively indicate the same as the vertical axis and the horizontal axis in FIG. 8. Similarly to FIG. 8, FIG. 11 illustrates the voltage V31 of the gate electrode 31, the voltage V32 of the source electrode 32, and the voltage V33 of the drain electrode 33.

The left part of FIG. 11 indicates a state in which a positive source signal Vs(+) is applied to the source electrode 32. The positive source signal Vs(+) is a source signal on which no correction voltage is superposed. Therefore, the left part of the graph representation in FIG. 11 is the same as that in FIG. 8.

Figure 12:
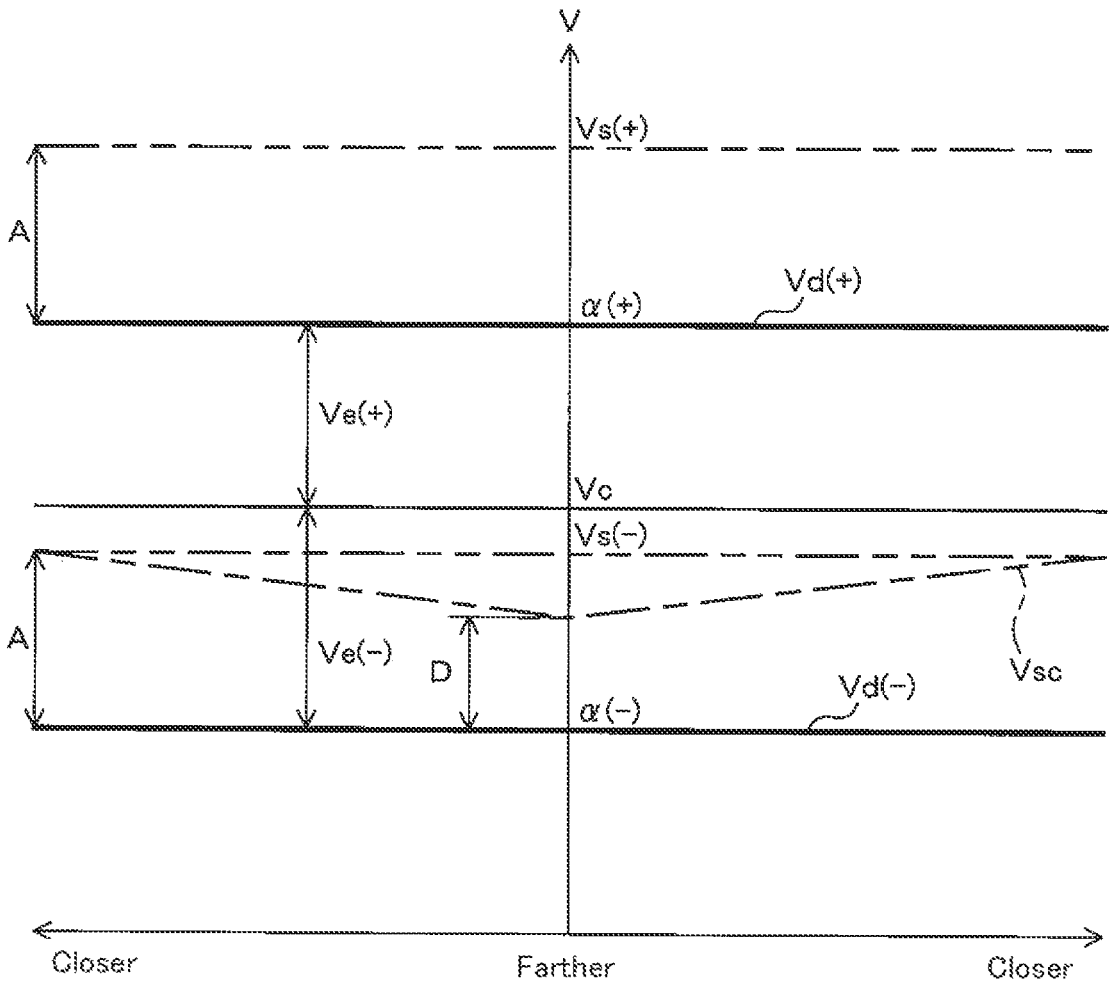
FIG. 12 is a graph representation showing relationships between the positive and negative source signals and the retention voltage when the Cgd gradation and the source signal adjustment are performed.

FIG. 12 is a graph representation showing relationships between the positive and negative source signals Vs(+) and Vs(−) and the retention voltages Vd(+) and Vd(−) when the Cgd gradation and the source signal adjustment are performed. In FIG. 12, a vertical axis and a horizontal axis respectively indicate the same as the vertical axis and the horizontal axis in FIG. 9. Similarly to FIG. 9, FIG. 12 illustrates the source signals Vs(+) and Vs(−), the retention voltages Vd(+) and Vd(−), and the common voltage Vc. In FIG. 12, the source signal Vsc on which a correction voltage is superposed is indicated by a dashed and dotted line. The correction voltage is expressed by {Vsc−Vs(−)}.

When the positive source signals Vs(+) are applied to the source electrodes 32 of the respective switching elements 3, the retention voltages Vd(+) of the pixel electrodes 41 are "α(+)", that is, equal to each other regardless of the distance from either of the gate application sections 11. Therefore, the effective voltages Ve(+) are equal to one another and the drawing voltages are equal to one another regardless of the distance from either of the gate application sections 11. Therefore, luminance difference present between the pixel 5 including the pixel electrode 41 located the farthest from the gate application sections 11 and the pixel 5 including the pixel electrode 41 located the closest to either of the gate application sections 11 is "0". In other words, when the positive source signals are applied to the drain electrodes 33, the voltages of the source signals applied to drain electrodes 33 having the same retention voltage are equal to one another.

The right part of FIG. 11 indicates a state in which the negative source signal Vsc is applied to a source electrode 32. When a gate signal is applied to a corresponding gate electrode 31, the voltage V33 of a corresponding drain electrode 33 changes gradually from the previous retention voltage and becomes constant at the voltage of the source signal Vsc. When the application of the gate signal to the gate electrode 31 ends, the voltage V33 of the drain electrode 33 gradually decreases from the voltage of the source signal Vsc and becomes constant at the retention voltage $\alpha(-)$. The drawing voltage at this time point is "D".

As can be understood from comparison between FIGS. 9 and 12, the negative source signal Vsc applied to a source line 22 corresponding to the switching element 3 located the closest to either of the gate application sections 11 is expressed by $\{\alpha(-)+A\}=Vs(-)$. The negative source signal Vsc applied to a source line 22 corresponding to the switching element 3 located the farthest from the gate application sections 11 is expressed by $\{\alpha(-)+D\}<Vs(-)$. The source signal Vsc gradually decreases from "$Vs(-)$" to "$\{\alpha(-)+D\}$" as the distance from the pixel electrode 41 to either of the gate application sections 11 increases.

As a result, as illustrated in FIG. 12, the retention voltages $Vd(-)$ of the pixel electrodes 41 are equal to one another, that is, "$\alpha(-)$" regardless of the distance from either of the gate application sections 11 when the negative source signals Vsc are applied to the source electrodes 32 of the respective switching elements 3. Therefore, the effective voltages $Ve(-)$ are equal to one another regardless of the distance from either of the gate application sections 11. Consequently, luminance difference between the pixel 5 including a pixel electrode 41 located far from either of the gate application sections 11 and the pixel 5 including a pixel electrode 41 located close to the gate application section 11 is "0". In other words, when negative source signals are applied to the respective drain electrodes 33, the longer the distance from either of the gate application sections 11 is, the lower the voltage of a source signal is (that is, the larger the absolute value of the voltage) among the source signals applied to drain electrodes 33 having the sane retention voltage.

In the display device 1 described above, the adjustment for each negative source signal is performed after the Cgd gradation for each positive source signal is performed. That is, the distance from the gate application sections 11 and the polarities of the source signals are both taken into consideration. Accordingly, luminance difference between the pixel 5 including a pixel electrode 41 located far from either of the gate application sections 11 and the pixel 5 including a pixel electrode 41 located close to the gate application section 11 can be reduced. In consequence, display quality of the display device 1 is improved.

Note that it is possible that the display device 1 includes one gate application section 11 and one end of each gate line 21 is connected to the gate application section 11. Alternatively or additionally, it is possible that the display device 1 includes two source application sections 12 and the opposite ends of each source line 22 are connected to the respective source application sections 12.

The negative source signal adjustment is performed after the Cgd gradation for the positive source signals is performed in the present embodiment, which should not be taken to limit the present disclosure. Conversely, the positive source signal adjustment may be performed after the Cgd gradation for the negative source signals are performed.

Furthermore, the correction voltage signals indicating the correction voltages are applied to the source application section from the controller 13 in the present embodiment, which should not be taken to limit the present disclosure. For example, it is possible that the source application section 12 pre-stores a correction voltage for each source line 22 (including a case where the source application section 12 includes for example resistors according to correction amounts) and the correction voltages are superposed on source signals applied to the source lines 22 when the source signals are negative.

The present embodiment will be summarized lastly below.

In an embodiment, the overlapping areas between the gate electrodes and the drain electrodes of the switching elements connected to the respective selected pixel electrodes are individually set to equalize or substantially equalize the retention voltages of the selected pixel electrodes when a specific voltage of the first polarity, which is either the positive polarity or the negative polarity, is applied to the selected pixel electrodes. The above serves as the Cgd gradation by which the overlapping areas are pre-adjustment. The controller further performs control such that a correction voltage preset for each source line is superposed on the source signals in application of the source signals by the source application section for applying voltages of a second polarity opposite to the first polarity to the selected pixel electrodes.

That is, the source signal adjustment taking the polarity of the source signals into consideration is performed while the Cgd gradation is performed. Thus, luminance difference between pixels is eliminated. Accordingly, degradation of display quality caused due to difference in distance from either of the gate application sections can be reduced and degradation of display quality caused due to difference in polarity of the source signals can be also reduced. In consequence, display quality of the display device is improved.

In another embodiment, the correction voltages are previously determined so as to equalize or substantially equalize the retention voltages of the selected pixel electrodes in application of a specific voltage of the second polarity to each selected pixel electrodes. Specifically, the longer the distance to the selected pixel electrode from either of the gate application sections is, the larger the absolute value of a correction voltage superposed on a source signal applied to each source line connected to the selected pixel electrodes is. In the above configuration, the pixels including the respective selected pixel electrodes are equal to or substantially equal to one another in luminance for the second polarity. Therefore, degradation of display quality of the display device caused due to the presence of excessive luminance difference can be reduced. By contrast, the source signal on which a correction voltage of 0 V is superposed is applied to the source line connected to the selected pixel electrode located the closest to either of the gate application sections.

In still another embodiment, the overlapping areas of the switching elements connected to the respective selected pixel electrodes are individually set so as to equalize or substantially equalize the drawing voltages of the selected pixel electrodes in application of the first polarity voltage to each selected pixel electrode. Specifically, the overlapping areas of the switching elements connected to the selected pixel electrodes increase as the distance from a selected pixel electrode to either of the gate application sections increases. In the above configuration, the pixels including the respective selected pixel electrodes are equal to or substantially equal in luminance to one another for the first polarity. Therefore, degradation of display quality of the display device caused due to the presence of excessive luminance difference can be reduced.

The embodiments as disclosed above in the present disclosure are mere examples in all aspects and should not be construed as limiting. The scope of the present disclosure is intended to include any variations within the meaning equivalent to the scope of claims and within the scope of claims rather than the meaning as described above.

What is claimed is:

1. A display device including a plurality of pixels arranged in a matrix, the plurality of pixels each including a pixel electrode, the display device comprising:

a plurality of gate lines extending side by side in a column direction of the matrix;

a plurality of source lines extending side by side in a row direction of the matrix and intersecting with the gate lines;

a plurality of switching elements that each include a gate electrode, a source electrode, and a drain electrode, and that are located in vicinity of respective intersection points of the gate lines and the source lines, each of the gate electrodes being connected to a corresponding one of the gate lines that passes through a corresponding one of the intersection points, each of the source electrodes being connected to a corresponding one of the source lines that passes through the corresponding one of the intersection points, each of the drain electrodes being connected to a corresponding one of the pixel electrodes of the plurality of pixels that is located in the vicinity of the corresponding one of the intersection points, a gate application section configured to sequentially apply gate signals to the gate lines, each of the gate signals being a signal for selecting a pixel group including pixels of the plurality of pixels arranged in the row direction of the matrix;

a source application section configured to apply source signals to the source lines, the source signals each being a signal for applying a desired voltage to selected pixel electrodes through the switching elements, the selected pixel electrodes being pixel electrodes of the pixels included in the pixel group selected by one of the gate signals; and a controller configured to control the gate application section and the source application section, wherein under control by the controller, the source application section alternately applies a positive voltage and a negative voltage to the selected pixel electrodes for each frame, a polarity of the voltage applied to the selected pixel electrodes being determined with reference to a specific voltage, overlapping areas between the gate electrodes and the drain electrodes of the switching elements connected to the respective selected pixel electrodes are individually set to equalize or substantially equalize drawing voltages of the selected pixel electrodes when a specific voltage of a first polarity is applied to each of the selected pixel electrodes, the first polarity being either a positive polarity or a negative polarity, the controller performs control such that correction voltages preset for the respective source lines are superposed on the source signals in application of the source signals for application of a voltage of a second polarity to each selected pixel electrode by the source application section, the second polarity being opposite to the first polarity, the correction voltages are previously determined to equalize or substantially equalize retention voltages of the selected pixel electrodes when a specific voltage of the second polarity is applied to each selected pixel electrode, and the retention voltages of the selected pixel electrodes are voltages reduced from a voltage applied to each selected pixel electrode by the respective drawing voltages.

2. The display device according to claim 1, wherein the controller performs control such that the correction voltages preset for the respective source lines are not superposed on the source signals in application of the source signals for application of the voltage of the first polarity to each selected pixel electrode by the source application section.

3. The display device according to claim 1, wherein the drawing voltages are determined according to parasitic capacities between the gate electrodes and the drain electrodes of the switching elements connected to the selected pixel electrode, a degree of roundness of a waveform of a gate signal applied to the gate electrode of the switching element connected to the selected pixel electrode, and potential differences between the gate electrodes and the source electrodes of the switching elements connected to the selected pixel electrode.

4. The display device according to claim 1, wherein an overlapping area of a switching element connected to the selected pixel electrode increases as a distance from the selected pixel electrode to the gate application section increases.

5. The display device according to claim 4, wherein longer the distance from the selected pixel electrode to the gate application section is, larger an absolute value of the correction voltage superimposed on the source signal applied to the source line connected to the selected pixel electrode is.

6. The display device according to claim 1, wherein longer a distance from the selected pixel electrode to the gate application section is, larger an absolute value of the correction voltage superposed on the source signal applied to the source line connected to the selected pixel electrode is.

7. The display device according to claim 1, wherein a source signal on which a correction voltage of 0 V is superposed is applied to a source line connected to a selected pixel electrode of the selected pixel electrodes located closest to the gate application section.

* * * * *